US005608925A

United States Patent [19]

Porter

[11] Patent Number: 5,608,925

[45] Date of Patent: Mar. 11, 1997

[54] WHEELCHAIR WITH BED PAN

[76] Inventor: Virginia M. Porter, 2220 E. Tremont Ave., Bronx, N.Y. 10462

[21] Appl. No.: 492,172

[22] Filed: Jun. 19, 1995

[51] Int. Cl.[6] ..... A61G 7/02

[52] U.S. Cl. ..... 4/480

[58] Field of Search ..... 4/476, 480, 483

[56] References Cited

U.S. PATENT DOCUMENTS

| | | | |
|---|---|---|---|
| 159,976 | 2/1875 | Steinbach | 4/483 |
| 2,037,578 | 4/1936 | Hoaglund et al. | 4/480 |
| 3,271,785 | 9/1966 | Du Bose | 4/480 |
| 3,611,457 | 10/1971 | Wippich | 4/480 |
| 4,207,633 | 6/1980 | Smith et al. . | |
| 5,058,222 | 10/1991 | Workman et al. . | |
| 5,373,591 | 12/1994 | Myers . | |

FOREIGN PATENT DOCUMENTS

| | | | |
|---|---|---|---|
| 0880385 | 3/1953 | Germany | 4/480 |

*Primary Examiner*—Charles E. Phillips
*Attorney, Agent, or Firm*—Helfgott & Karas, PC.

[57] ABSTRACT

A wheelchair seat is formed with an aperture around which a toilet seat and lid are mounted. A bed pan support and removable bed pan are positioned directly below the aperture. The bed pan may be easily installed and removed from the support from the rear of the wheel chair seat without disturbing the occupant of the wheelchair.

11 Claims, 3 Drawing Sheets

WHEELCHAIR WITH BED PAN

BACKGROUND OF THE INVENTION

Field of the Invention

The present invention relates in general to a wheelchair adapted for receiving a removable bed pan and particularly relates to such a wheelchair fitted with a toilet seat aligned with the bed pan. Description of Prior Developments Wheelchairs with waste collection capabilities are well known. An example of such a wheelchair is described in U.S. Pat. No. 5,058,222 wherein a relatively complicated motor-driven assembly selectively engages and retracts from a patient's buttocks for the purpose of conveying human waste to a remote receptacle. Although this system performs satisfactorily, it is relatively complex in design and costly to manufacture. Moreover, the entire system requires custom parts and fabrication.

Accordingly, a need exists for a simple, inexpensive wheelchair with waste collection capabilities which does not require any specialized components and which can be constructed from readily available parts which may be supplied in kit form.

SUMMARY OF THE INVENTION

The present invention has been developed to fulfill the needs noted above and therefore has as an object the provision of a wheelchair which includes an easily removable waste collection receptacle which can take the form of a conventional bed pan.

Another object of the invention is the provision of a wheelchair which includes a toilet seat and closable lid aligned with a bed pan which is supported beneath the wheelchair.

Another object of the invention is the provision of a wheelchair and bed pan assembly which may be economically constructed from readily available components which may be supplied as a kit.

Still another object of the invention is to provide a wheelchair and bed pan assembly having a bed pan support which allows for the convenient removal and replacement of the bed pan from the rear of the wheelchair so as to avoid disturbing the wheelchair occupant.

Another object of the invention is the provision of a wheelchair and bed pan assembly which allows for the quick and simple manual removal of both the bed pan and bed pan support in order to return the wheelchair to what would appear to be a conventional wheelchair.

Yet another object of the invention is the provision of a wheelchair and bed pan assembly which obviates the need for a wheelchair occupant to wear diapers and which allows the occupant to remain unattended for certain periods of time, if desired.

The above and other objects of the invention are met by the present invention which is directed to a wheelchair fitted with a toilet seat beneath which a removable bed pan is mounted. Access to the bed pan is from the rear of the wheelchair thereby allowing the occupant of the wheelchair to remain seated during installation and removal of the bed pan.

Because of the use of readily available components and because of the simple construction of the invention, an economical wheelchair and bed pan assembly results which may be constructed from a kit. It is possible to easily retrofit an existing wheelchair in accordance with the invention.

Use of the invention allows for the elimination of the use of diapers by the wheel chair occupant, thereby eliminating the possibility of skin irritation associated with diaper use. Moreover, a wheelchair occupant need not experience any embarrassment associated with the use of diapers nor incur the expense of their purchase. In addition, by avoiding the use of diapers, environmental waste disposal problems are reduced.

The present invention includes a conventional wheelchair provided with an apertured seat upon which a toilet seat and cover are mounted. A receptacle or mounting assembly for a removable bed pan is provided adjacent the underside of the aperture.

The present invention is particularly adapted for retrofitting existing wheelchairs using commonly available components such as toilet seats, elastic tie downs such as bungee cords and plastic containers for supporting a bed pan beneath the toilet seat. In use, an occupant may either sit on or over the closed lid of the toilet seat or directly on the open toilet seat with the lid resting against the back rest of the wheelchair. In the latter case, invalid occupants may be left unattended for a certain period of time without fear of them becoming distressed due to normal bodily functions. In the former case, a pad or pillow may be placed over the closed lid thereby providing the appearance of a conventional wheelchair.

Since the present invention is adapted to use standard commercially-available bed pans, such as the type in use in hospitals, existing bed pan cleaning apparatus may be used without additional expense.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

Figure 1:
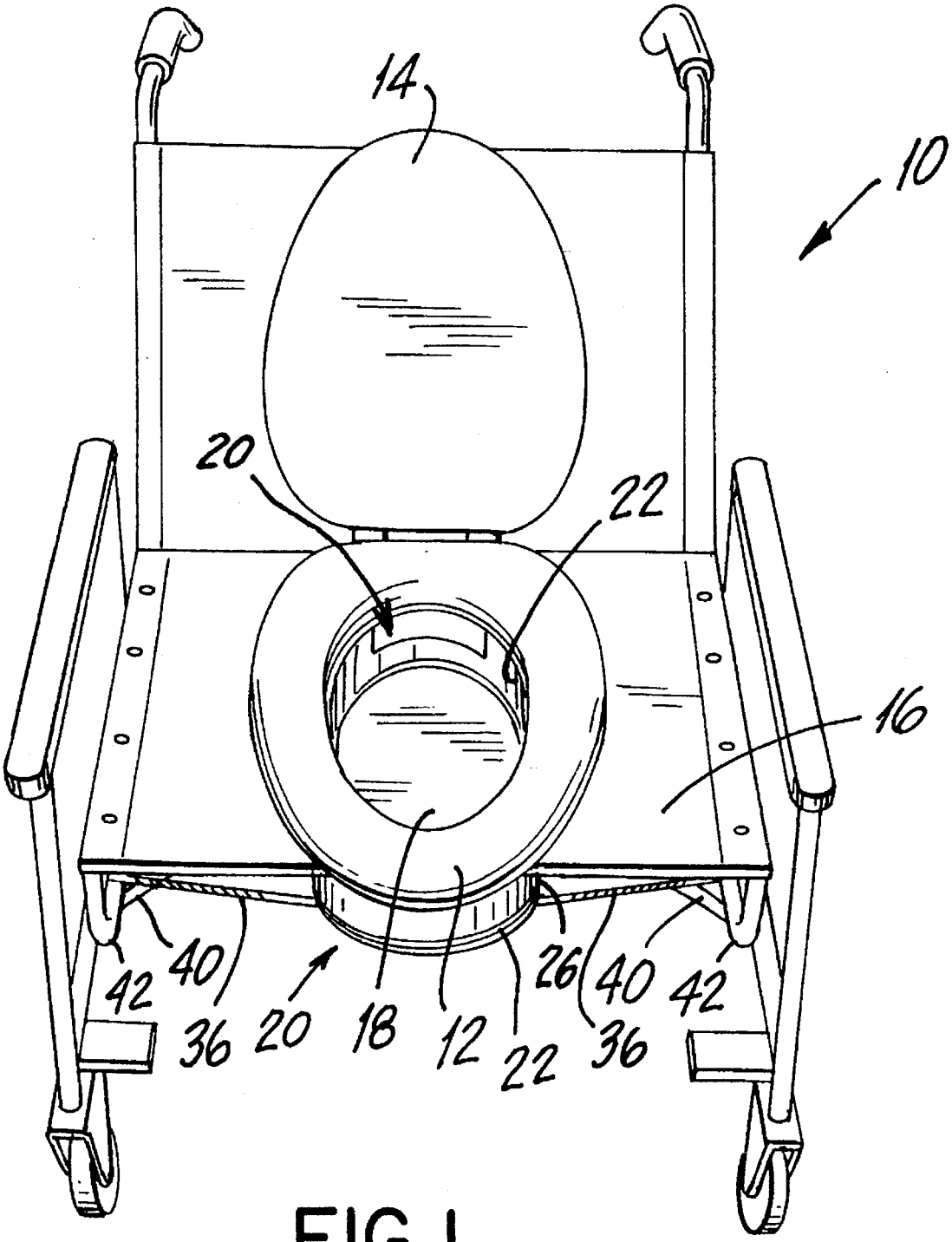
FIG. 1 is a front perspective view of a wheelchair constructed in accordance with the present invention.

The present invention will now be described in conjunction with the drawings, beginning with FIG. 1 which shows a wheelchair 10 of generally conventional design fitted with a toilet seat 12 and lid 14 according to the invention. Toilet seat 12 and lid 14 may be mounted as a separate assembly on wheelchair seat 16 such as by adhesives and/or conventional fasteners. Alternatively, seat 12 may be manufactured integrally with seat 16 and mounted to wheelchair 10 as a single component, with lid 14 installed separately.

Figure 2:
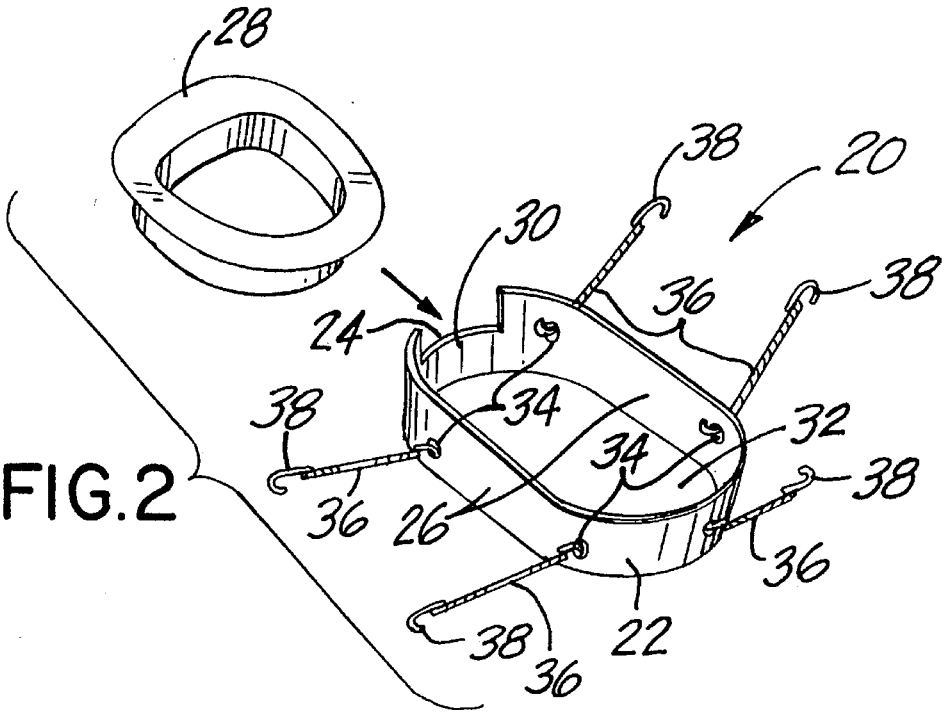
FIG. 2 is a perspective view of a bed pan and bed pan mounting assembly.

A portal or aperture 18 is formed through the central portion of wheelchair seat 16 to provide access to a bed pan assembly 20 mounted directly below the wheelchair seat 16. As seen in FIG. 2, the bed pan assembly 20 includes a bed pan support 22 which may take the form of an open-ended receptacle, open frame, simple shelf or similar retainer.

In the example of FIG. 2, bed pan support 22 is constructed from a conventional plastic container or basin which is initially formed, truncated or subsequently cut at one end to leave an opening 24 sized to receive a standard bed pan. The sidewalls 26 of the bed pan support 22 may be spaced apart so that they are resiliently deflected outwardly as bed pan 28 is placed therein. Alternatively, the bed pan may have a free sliding clearance fit within and between sidewalls 26 and beneath the wheelchair seat 16. A small ridge 30 may be formed at the bottom of rear opening 24 extending upwardly from the floor 32 of support 22 to prevent the bed pan from sliding out rearwardly.

A plurality of mounting holes 34 may be formed along the sidewalls 26 of the support 22 for receiving fasteners for securing the support 22 to wheelchair 10. Fasteners such as elastic cords 36 fitted with hooked metal ends 38, sometimes referred to as bungee cords, may be used to removably mount support 22 to various suitable anchoring points on seat 16 or on the frame 40 of wheelchair 10.

Figure 3:
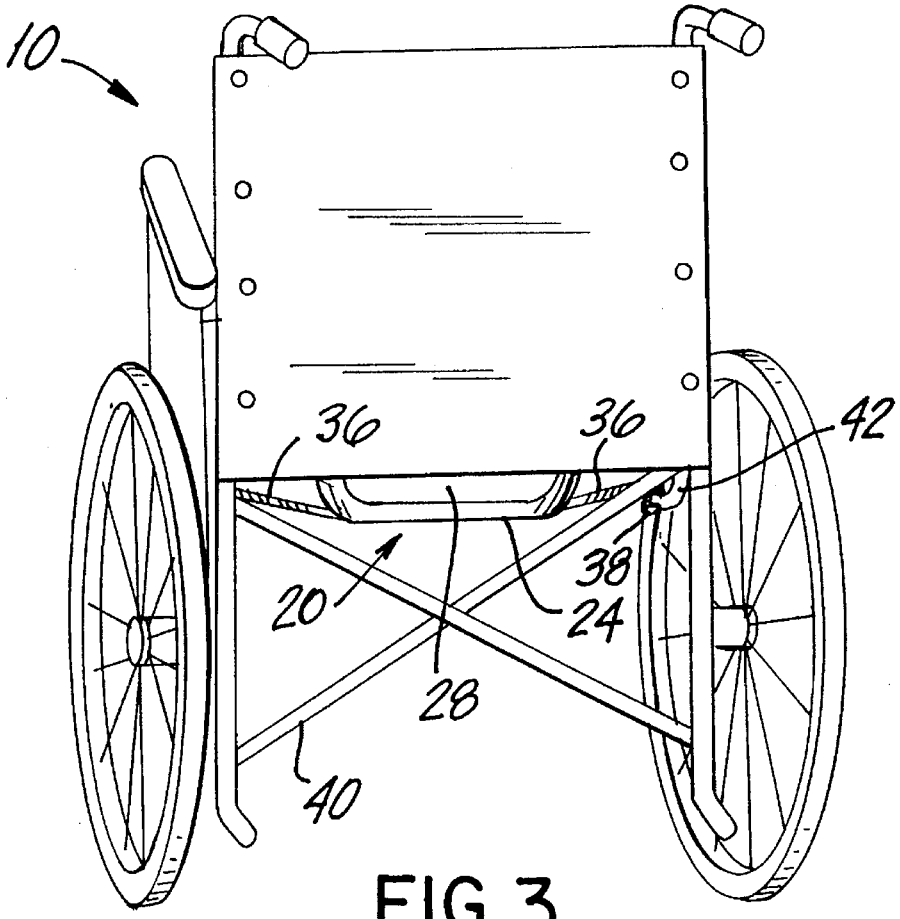
FIG. 3 is a rear perspective view of FIG. 1.

One set of hooked ends 38 may be easily inserted into holes 34 while the hooks on the other ends of cords 36 may be hooked in tension to any convenient anchor points along the wheelchair 10. As seen in FIGS. 1 and 3, the front pair of bungee cords may be hooked in tension around the front end of the frame side rails 42 which extend along opposite sides of the wheelchair seat 16. The rear pair of bungee cords is similarly hooked around the rear ends of the frame side rails 42 so as to bias the support 22 beneath and toward seat 16.

Figure 4:
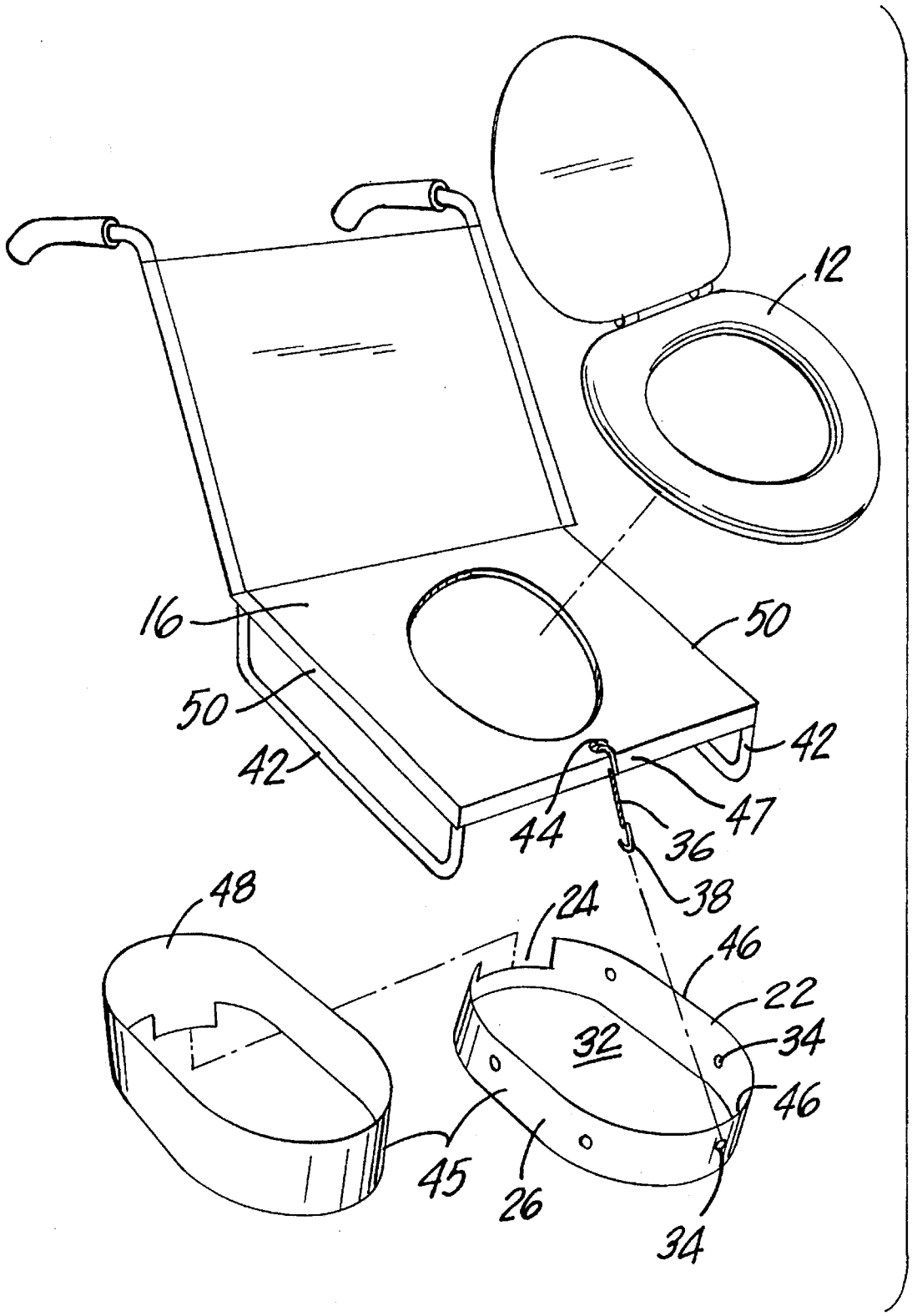
FIG. 4 is a schematic exploded view of a wheelchair seat, toilet seat and bed pan support according to the invention.

As seen in FIG. 4, a mounting hole 44 may be formed in the front center of wheelchair seat 16 about ½ or ¾ inch back from front edge 47 for receiving a short (1 inch long) bungee cord hooked to the front center of bed pan support 22 (FIG. 2). This front bungee cord 36 secures the front end of bed pan support 22 in position and prevents the bed pan from sliding out the front of bed pan support 22.

Elastic cords 36 are preferred because of their low cost and ease of manually mounting and demounting, however any fastener or bonding agent may be used to mount the bed pan support to the wheelchair 10. For example, screws, nails, staples, clamps and glue could be used as alternatives to bungee cords.

Although the invention includes the original manufacture or assembly of the wheelchair, toilet seat and bed pan support by an original equipment manufacturer, it is also possible to carry out the invention in kit form by an end user as a retrofit assembly for existing wheelchairs. In this case, a kit containing at least a toilet seat, bed pan support and fasteners is provided. In one particular embodiment, a kit could include the above items and, in addition, as many of the following items as desired: large needle, nylon thread, stapler, marker pen, glue with or without glue gun, bed pan (medium size), plastic oval basket provided with or without mounting holes (8-¾ inches wide, 10 inches long and 2-½ to 3-½ inches deep).

Using the items listed above, an existing wheelchair may be modified or retrofitted in accordance with the invention by the following procedure. First, the toilet seat, with lid attached, is placed over the seat of the wheelchair. The outline of the inner diameter or border of the toilet seat is then marked on the wheelchair seat using the marker pen. The front of the toilet seat may project slightly over and in front of the wheelchair seat by a small amount, i.e. ¼ inch, to provide adequate space for the pivotal movement of the toilet seat lid backward into a resting position against the back rest of the wheelchair.

The marked outline of the toilet seat is then cut out through the seat of the wheelchair by any suitable manner such as by a knife and jig saw. The cut edges of the materials and padding on the wheelchair seat are then sewn closed. The scrap material from the cut-out portion of the wheelchair seat may then be cut to size and glued over the stitches to provide a border having a finished appearance. The glued border may be held in place with staples during bonding.

Next, the bottom of the toilet seat is aligned over the aperture cut in the seat of the wheelchair and glued in place, making sure that the lid of the toilet seat can freely pivot into a rest position against the back of the wheelchair.

As shown schematically in FIG. 4, the plastic oval basket 45 is then cut circumferentially at a height of about 3 inches above floor 32 to form sidewall edge 46. The upper portion 48 of the basket is discarded. An additional cut is made at the rear end of the basket to form the rear opening 24 for receiving the bed pan. The remaining rear sidewall height below opening or step 24 is about 2 inches above floor 32.

Mounting holes 34 are then cut into the sidewall 26 at a point about ½ inch above the floor 32. Two such mounting holes are formed in front of the plastic basket, two in the back and one at front center. The center front hole may be cut midway up front sidewall 26 at a height of about 1-½ inches above floor 32.

Four 4-inch long bungee cords are then respectively hooked into each mounting hole. The remaining loose ends of the bungee cords are then hooked around a suitable point on the frame of the wheelchair with the open or stepped end of the cut oval basket facing the rear of the wheelchair. Anchoring points for the bungee cords include a pair of steel rails 42 which typically extend from front to back alongside or underneath the wheelchair seat 16. The free ends of the bungee cords could also be hooked around the side edges 50 of the wheelchair seat itself. This completes the assembly except for sliding the bed pan into the basket from the rear of the wheelchair.

There has been disclosed heretofore the best embodiment of the invention presently contemplated. However, it is to be understood that various changes and modifications may be made thereto without departing from the spirit of the invention.

What is claimed:

1. A wheelchair, comprising:

a wheelchair frame having a front end portion and a rear end portion;

a wheelchair seat attached to said frame, said wheelchair seat having an aperture formed therein;

a toilet seat provided on said wheelchair seat adjacent said aperture;

a manually removable bed pan support resiliently mounted below said wheelchair seat and aligned with said aperture for receiving, supporting and positioning a bed pan directly below said aperture; and a plurality of manually fastenable resilient fasteners extending between said bed pad support and said wheelchair frame add biasing said bed pan support toward said toilet seat.

2. The wheelchair of claim 1, wherein said toilet seat further comprises a movable lid for opening and closing said aperture.

3. The wheelchair of claim 1, wherein said bed pan support comprises a plastic receptacle.

4. The wheelchair support of claim 3, wherein said plastic receptacle comprises a floor and a sidewall, said sidewall defining an opening facing said rear end portion of said wheelchair frame for receiving said bed pan.

5. The wheelchair of claim 4, wherein said sidewall is dimensioned to freely receive and retain said bed pan with a sliding clearance fit.

6. The wheelchair of claim 4, wherein said sidewall is formed with a plurality of apertures.

7. The wheelchair of claim 6, wherein said plurality of fasteners respectively extend through said plurality of apertures.

8. The wheelchair of claim 7, wherein said plurality of fasteners comprises a plurality of bungee cords.

9. The wheelchair of claim 8, wherein said bungee cords are resiliently hooked in tension to said wheelchair frame.

10. The wheelchair of claim 1, further comprising a bed pan supported on said bed pan support and disposed directly below said aperture.

11. A kit for adapting a conventional wheelchair for toilet operation, said kit comprising:

a toilet seat and lid adapted for mounting over a central portion of a wheelchair seat;

a bed pan support adapted for resilient mounting below said central portion of said wheelchair seat, said bed pad support having a plurality of apertures formed therein;

manually operated fasteners for fastening said bed pan support to said wheelchair, comprising a plurality of hooked elastic cords manually engagable with said bed pan support through said apertures for resiliently mounting said bed pad support to said wheelchair and biasing said bed pan toward said toilet seat; and a bed pan removably engagable with said bed pan support adjacent said rear end portion of said wheelchair seat.

* * * * *